US010347419B2

(12) United States Patent
Kim et al.

(10) Patent No.: US 10,347,419 B2
(45) Date of Patent: Jul. 9, 2019

(54) COIL ELECTRONIC COMPONENT AND METHOD FOR MANUFACTURING THE SAME

(71) Applicant: SAMSUNG ELECTRO-MECHANICS CO., LTD., Suwon-si, Gyeonggi-do (KR)

(72) Inventors: Jae Hun Kim, Suwon-si (KR); Byeong Cheol Moon, Suwon-si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 35 days.

(21) Appl. No.: 15/391,216

(22) Filed: Dec. 27, 2016

(65) Prior Publication Data

US 2017/0345556 A1 Nov. 30, 2017

(30) Foreign Application Priority Data

May 25, 2016 (KR) ..... 10-2016-0064200

(51) Int. Cl.

| | |
|---|---|
| ***H01F 27/29*** | (2006.01) |
| ***H01F 41/04*** | (2006.01) |
| ***H01F 17/00*** | (2006.01) |
| ***H01F 17/04*** | (2006.01) |

(52) U.S. Cl.

CPC ..... *H01F 41/042* (2013.01); *H01F 17/0013* (2013.01); *H01F 17/04* (2013.01); *H01F 27/292* (2013.01); *H01F 2017/048* (2013.01)

(58) Field of Classification Search

CPC . H01F 5/00; H01F 27/28; H01F 27/29; H01F 27/24; H01F 27/34; H01F 27/2804

USPC ..... 336/200, 232

See application file for complete search history.

(56) References Cited

U.S. PATENT DOCUMENTS

| | | | | |
|---|---|---|---|---|
| 6,115,264 | A | 9/2000 | Nosaka | |
| 6,140,902 | A | 10/2000 | Yamasawa et al. | |
| 6,600,404 | B1 * | 7/2003 | Kajino | 336/200 |
| 7,719,398 | B2 * | 5/2010 | Tsuzuki | H01F 17/0013 336/200 |
| 2013/0249664 | A1 * | 9/2013 | Tonoyama | H01F 41/04 336/200 |
| 2014/0034373 | A1 | 2/2014 | Yoshikawa et al. | |
| 2014/0145812 | A1 | 5/2014 | Lee et al. | |
| 2014/0306792 | A1 * | 10/2014 | Yoneda et al. | 336/200 |
| 2015/0155084 | A1 * | 6/2015 | Kim et al. | 336/200 |

(Continued)

FOREIGN PATENT DOCUMENTS

| | | |
|---|---|---|
| JP | 10-055916 A | 2/1998 |
| JP | 10-241983 A | 9/1998 |
| JP | 11-186038 A | 7/1999 |

(Continued)

OTHER PUBLICATIONS

Korean Office Action issued in Korean Patent Application No. 10-2016-0064200, dated Jun. 21, 2017, with English Translation.

*Primary Examiner* — Tszfung J Chan

(74) *Attorney, Agent, or Firm* — Morgan, Lewis & Bockius, LLP

(57) ABSTRACT

A coil electronic component includes: a body including a substrate and coil parts disposed on first and second surfaces of the substrate; and external electrodes formed on outer surfaces of the body and connected to the coil parts. A metal layer is disposed within the substrate.

10 Claims, 5 Drawing Sheets

(56) References Cited

U.S. PATENT DOCUMENTS

2016/0163444 A1 6/2016 Choi et al.

FOREIGN PATENT DOCUMENTS

| | | | | |
|---|---|---|---|---|
| JP | 2004-103624 | A | | 4/2004 |
| JP | 2006-278479 | A | | 10/2006 |
| JP | 2006332147 | A | * | 12/2006 |
| JP | 2007067214 | A | * | 3/2007 |
| JP | 2008166391 | A | * | 7/2008 |
| JP | 2014-032978 | A | | 2/2014 |
| JP | 2015-126199 | A | | 7/2015 |
| KR | 2014-0066437 | A | | 6/2014 |
| KR | 10-1598295 | B1 | | 2/2016 |

* cited by examiner

COIL ELECTRONIC COMPONENT AND METHOD FOR MANUFACTURING THE SAME

CROSS-REFERENCE TO RELATED APPLICATION(S)

This application claims the benefit of priority to Korean Patent Application No. 10-2016-0064200, filed on May 25, 2016 in the Korean Intellectual Property Office, the entire disclosure of which is incorporated herein by reference.

TECHNICAL FIELD

The present disclosure relates to a coil electronic component and a method for manufacturing the same.

BACKGROUND

An inductor, a type of electronic chip component, is a representative passive element configuring an electronic circuit, together with a resistor and a capacitor, to remove noise.

A thin-film type inductor may be manufactured by forming internal coil parts by means of plating, hardening a magnetic powder-resin composite in which magnetic powders and a resin are mixed with each other to manufacture a body, and then forming external electrodes on outer surfaces of the body.

SUMMARY

An aspect of the present disclosure may provide a coil electronic component and a method for manufacturing the same that is capable of increasing inductance and improving rigidity of an electronic component, based on an increase in the number of turns of a coil, by inserting a metal layer into a substrate.

According to an aspect of the present disclosure, a coil electronic component includes: a body including a substrate and coil parts disposed on first and second surfaces of the substrate; and external electrodes formed on outer surfaces of the body and connected to the coil parts, wherein a metal layer is disposed within the substrate.

According to another aspect of the present disclosure, a method for manufacturing a coil electronic component includes: applying insulating films on a support member on which a base conductor layer is disposed, and patterning the insulating films so that portions of the base conductor layer are exposed; forming a first coil part by performing plating on the base conductor layer between the patterned insulating films; laminating the insulating film on the first coil part and machining a first via; forming a metal layer by performing plating on the first via and the insulating film and performing a patterning; and laminating the insulating film on the metal layer and machining a second via to form a second coil part on the insulating film and the first via, wherein the metal layer is disposed between the first and second coil parts.

BRIEF DESCRIPTION OF DRAWINGS

The above and other aspects, features and other advantages of the present disclosure will be more clearly understood from the following detailed description when taken in conjunction with the accompanying drawings, in which.

DETAILED DESCRIPTION

Hereinafter, exemplary embodiments of the present disclosure will be described in detail with reference to the accompanying drawings.

Coil Electronic Component

Figure 1:
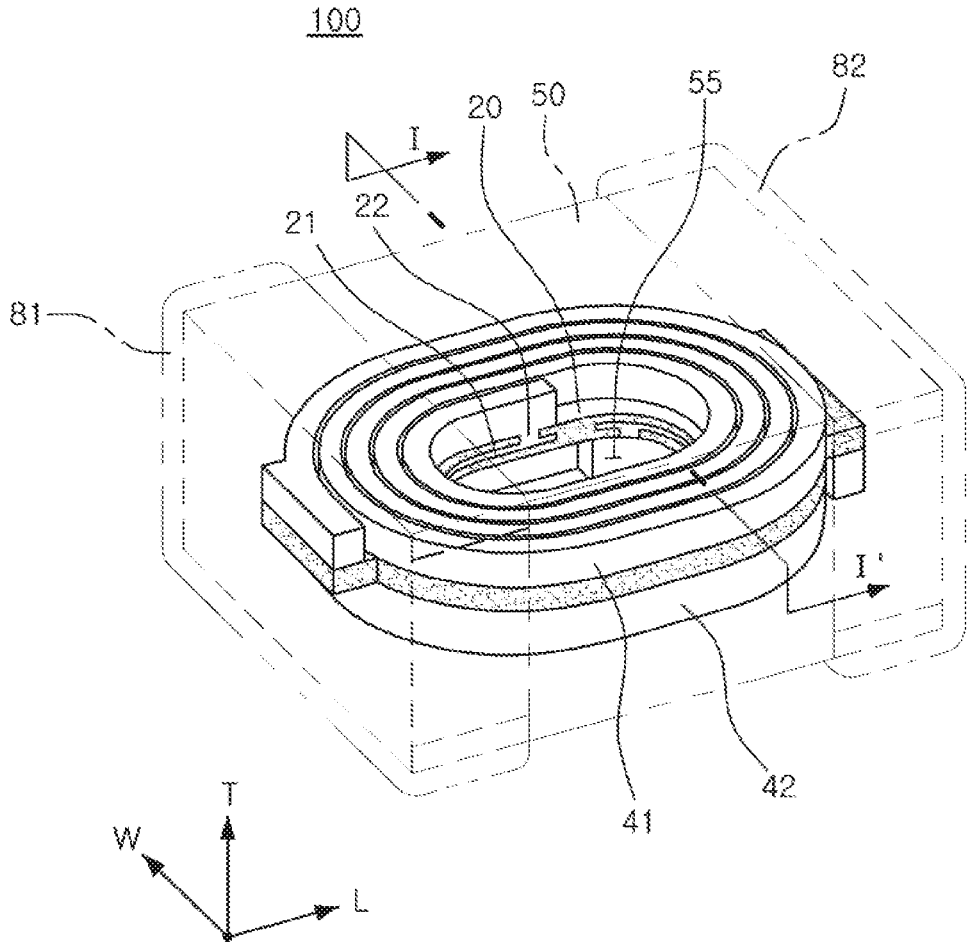
FIG. 1 is a schematic perspective view illustrating a coil electronic component according to an exemplary embodiment in the present disclosure so that a coil part of the coil electronic component is visible.

FIG. 1 is a schematic perspective view illustrating a coil electronic component according to an exemplary embodiment in the present disclosure, so that a coil part of the coil electronic component is visible.

Figure 2:
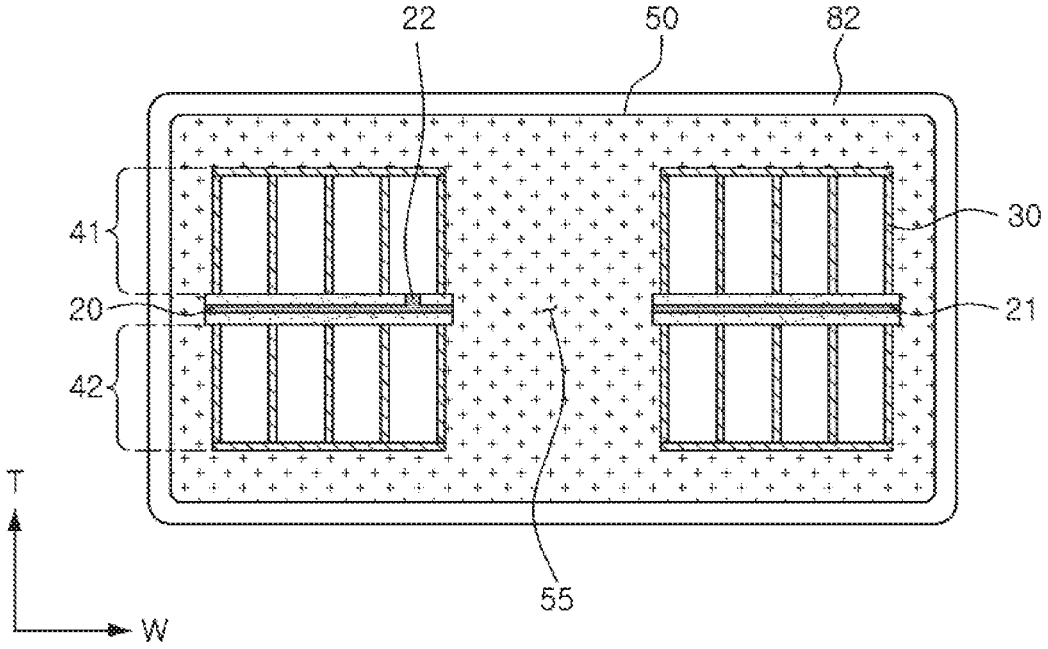
FIG. 2 is a cross-sectional view taken along line I-I' of FIG. 1.

FIG. 2 is a cross-sectional view taken along line I-I' of FIG. 1.

Referring to FIGS. 1 and 2, as an example of a coil electronic component 100, a thin film type inductor used in a power line of a power supply circuit is disclosed.

The coil electronic component 100, according to an exemplary embodiment, may include a body 50, coil parts 41 and 42 embedded in the body 50, and first and second external electrodes 81 and 82 disposed on outer surfaces of the body 50 and electrically connected to the coil parts 41 and 42.

In the coil electronic component 100 according to an exemplary embodiment, a 'length direction' refers to an 'L' direction of FIG. 1, a 'width direction' refers to a 'W' direction of FIG. 1, and a 'thickness direction' refers to a 'T' direction of FIG. 1.

The body 50 may form an exterior of the coil electronic component 100, and may be formed of any material without being limited as long as the material exhibits magnetic properties. For example, the body 50 may be formed by filling a ferrite or a metallic magnetic powder.

The ferrite may be, for example, a Mn—Zn based ferrite, a Ni—Zn based ferrite, a Ni—Zn—Cu based ferrite, a Mn—Mg based ferrite, a Ba-based ferrite, a Li-based ferrite, or the like.

The metallic magnetic powder may include any one or more selected from the group consisting of iron (Fe), silicon (Si), chromium (Cr), aluminum (Al), and nickel (Ni). For example, the metallic magnetic powder may be a Fe—Si—B—Cr based amorphous metal, but is not necessarily limited thereto.

The metallic magnetic powder may have a particle diameter of 0.1 μm to 30 μm, and may be in a form in which it is dispersed in an epoxy resin or a thermosetting resin such as polyimide, or the like.

A first coil part 41 having a coil shape may be formed on a first surface of a substrate 20 disposed in the body 50, and a second coil part 42 having the coil shape may be formed on a second surface of the substrate 20 opposing the first surface of the substrate 20.

The first and second coil parts 41 and 42 may be formed by performing electroplating or chemical plating.

The substrate 20 may be formed of, for example, a polypropylene glycol (PPG) substrate, a ferrite substrate, a metal based soft magnetic substrate, or the like.

A central portion of the substrate 20 may be penetrated to form a hole, and the hole may be filled with a magnetic material to form a core part 55. As the core part 55 filled with the magnetic material is formed, inductance Ls may be improved.

The first and second coil parts 41 and 42 may be formed in a spiral shape.

The first and second coil parts 41 and 42 may be formed of a metal having excellent electrical conductivity, and may be formed of, for example, silver (Ag), palladium (Pd), aluminum (Al), nickel (Ni), titanium (Ti), gold (Au), copper (Cu), platinum (Pt), or an alloy thereof.

According to an exemplary embodiment, a metal layer 21 may be inserted into the substrate 20.

In general, the thin film inductor may have a two-layer structure, and may be manufactured in a form in which a coil starting from the outside is wound in a spiral shape, is connected to a lower layer through a via at the center of the inductor, and is then outwardly wound.

Currently, in the case of the thin film inductor of 1005 size (a length and a width are 1.0 mm and 0.5 mm, respectively), a thickness of the substrate disposed between a first coil and a second coil is 60 μm.

In the current operation, due to a problem such as a rolling of the substrate during the operation, the thickness of the substrate may not be decreased.

As the size of the inductor is decreased, a ratio of volume occupied by the substrate disposed in the inductor may be increased, which has an inverse influence on securing capacitance. Therefore, it is very important to decrease a fraction of volume occupied by the substrate within the component.

According to an exemplary embodiment, the metal layer 21 is inserted into the substrate 20, whereby rigidity of the substrate may be improved, thereby improving reliability of the coil electronic component.

In addition, since the rigidity of the substrate may be improved, the thickness of the substrate may be formed to be thinner, whereby the fraction of volume occupied by the substrate within the component may be further decreased.

Thereby, even if the size of the coil electronic component is miniaturized, a problem of inductance degradation may be avoided.

The thickness of the substrate 20 may be 5 μm or more to 60 μm or less.

According to an exemplary embodiment, since the metal layer 21 is inserted into the substrate 20, the rigidity of the substrate may be improved. Therefore, even in the case of a subminiature inductor product, the substrate may be manufactured to have the thickness of 60 μm or less.

That is, by manufacturing the substrate to have the thickness of 60 μm or less, even in a case in which the fraction of volume occupied by the substrate within the electronic component is significantly reduced, since a defect such as the rolling of the substrate does not occur, the problem of inductance degradation of the subminiature inductor product may be avoided.

In addition, the metal layer 21 may have a coil form.

Since the metal layer 21 is disposed within the substrate 20 in the coil form and is connected to the coil parts 41 and 42 through the via 22, as described below, an effect of increasing the number of windings may occur. As a result, the inductance of the coil electronic component may be increased.

Figure 3:
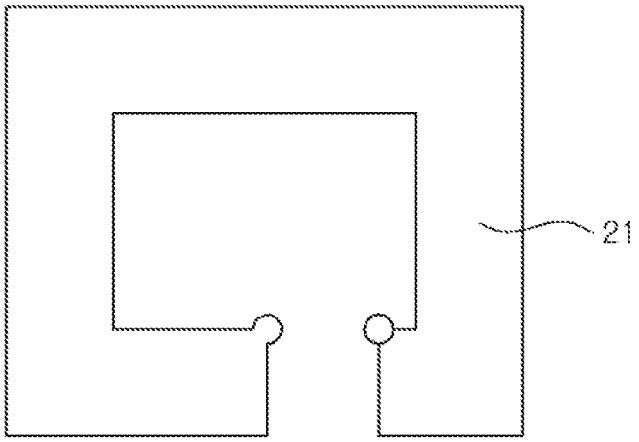
FIG. 3 is a plan view of a metal layer of the coil electronic component according to an exemplary embodiment which is viewed from the top.

FIG. 3 is a plan view of a metal layer of the coil electronic component according to an exemplary embodiment which is viewed from the top.

Referring to FIGS. 2 and 3, the metal layer 21 may be wider than it is thick.

More specifically, the metal layer 21 may have an aspect ratio of less than 1.0, the aspect ratio being a ratio of a thickness to a width.

In contrast, the coil parts 41 and 42 may be thicker than they are wide, and may have an aspect ratio of 1.0 or more, the aspect ratio being a ratio of a thickness to a width.

Examples of a method for increasing a cross-sectional area of the coil parts may include a method for increasing a width of the coil and a method for increasing a thickness of the coil.

However, when the width of the coil is increased, a risk of an occurrence of a short-circuit between neighboring coils may be significantly increased, a limit to the number of turns of the coil which may be implemented may occur, which causes an area of a magnetic body to be reduced, to thereby deteriorate efficiency, and there may be a limitation in implementing a high capacity product.

Therefore, the coil parts of a structure may have a high aspect ratio (AR), which may be implemented by increasing the thickness of the coil compared to the width of the coil.

An aspect ratio (AR) of the coil parts means a value obtained by dividing the thickness of the coil by the width of the coil. As an increased thickness of the coil is greater than an increased width of the coil, the high aspect ratio (AR) may be obtained.

According to an exemplary embodiment, the coil parts 41 and 42 may have the aspect ratio of 1.0 or more, the aspect ratio being a ratio of the thickness to the width, in order to secure high inductance, and the cross-sectional area of the coil parts may be increased by further increasing the thicknesses of the coil parts in order to obtain low direct current (DC) resistance Rdc.

In contrast, the metal layer 21 may have a shape in which a width is greater than a thickness, unlike the coil parts 41 and 42, and may have the aspect ratio of less than 1.0, the aspect ratio being a ratio of a thickness to a width.

Due to the shape of the metal layer 21 described above, electrical loss of the DC resistance Rdc and of capacity may be prevented.

The first and second coil parts 41 and 42 formed on the first and second surfaces of the substrate 20 may be connected to the metal layer 21 through the via 22 formed in the substrate 20.

Since the metal layer 21 is disposed within the substrate 20 in the coil form and is connected to the coil parts 41 and 42 through the via 22, as described below, an effect of increasing the number of windings may occur. As a result, the inductance of the coil electronic component may be increased.

The via 22 may be formed of a metal having excellent electrical conductivity, and may be formed of, for example, silver (Ag), palladium (Pd), aluminum (Al), nickel (Ni), titanium (Ti), gold (Au), copper (Cu), platinum (Pt), or an alloy thereof.

In addition, the via 22 may be formed by filling a conductive metal by electroplating.

Referring to FIG. 2, the coil electronic component according to an exemplary embodiment may include the body 50, wherein the body 50 may include the substrate 20, patterned insulating films 30 disposed on the substrate 20, and the first and second coil parts 41 and 42, formed between the patterned insulating films 30 by plating.

The first and second coil parts 41 and 42 may be formed by isotropic plating having a small thickness distribution, and may be formed in a single plating process.

The isotropic plating may refer to a plating method in which a width and a thickness of a plating layer are simultaneously grown, and is a technology contrasted with an anisotropic plating method in which growth speeds of the plating in a width direction of the plating layer and a thickness direction thereof are different.

In addition, since the first and second coil parts 41 and 42 are formed between the patterned insulating films 30 by the isotropic plating, a shape thereof may be a rectangular shape. However, the shape of the first and second coil parts 41 and 42 may be slightly modified by varying the process.

Since the first and second coil parts 41 and 42 have the rectangular shape, the cross-section area of the coil parts may be increased, and the area of the magnetic body may be increased, thereby reducing the DC resistance (Rdc) and improving the inductance.

Further, since a structure having a high aspect ratio (AR) may be implemented by increasing a ratio of a thickness to a width of the first and second coil parts 41 and 42, the cross-sectional area of the coil parts may be increased and DC resistance (Rdc) characteristics may be improved.

According to an exemplary embodiment, the body 50 may include the patterned insulating films 30 disposed on the substrate 20.

In the case of a general coil electronic component, after the coil parts are formed on the substrate, the insulating film is formed to cover the coil parts.

However, according to an exemplary embodiment, in order to implement low DC resistance (Rdc) by allowing a thickness of the coil parts to be uniform and to reduce defects in which an insulating layer is not formed in a space between coil patterns by forming the coil parts without being bent, the insulating films 30 may be patterned on the substrate 20 before forming the coil parts.

The insulating films 30, which are photosensitive insulating films, may be formed of, for example, an epoxy based material, but are not necessarily limited thereto.

In addition, the insulating films 30 may be formed by an exposure and development operation of a photo resist (PR).

The coil parts 41 and 42 may not be in direct contact with a magnetic material forming the body 50, due to the patterned insulating films 30.

A detailed operation of forming the patterned insulating films 30 and the coil parts 41 and 42 disposed between the patterned insulating films 30, according to an exemplary embodiment, will be described below.

One end portion of the first coil part 41, formed on one surface of the substrate 20, may be exposed to one end surface of the body 50 in the length L direction of the body 50, and one end portion of the second coil part 42, formed on the other surface of the substrate 20, may be exposed to the other end surface of the body 50 in the length L direction of the body 50.

However, one end portion of each of the first and second coil parts 41 and 42 is not necessarily limited thereto. For example, one end portion of each of the first and second coil parts 41 and 42 may be exposed to at least one surface of the body 50.

The first and second external electrodes 81 and 82 may be formed on the outer surfaces of the body 50 so as to be connected to each of the first and second coil parts 41 and 42, which are exposed to the end surfaces of the body 50.

Method for Manufacturing Coil Electronic Component

FIGS. 4A through 4L are views sequentially illustrating a method for manufacturing a coil electronic component according to an exemplary embodiment in the present disclosure.

Referring to FIGS. 4A through 4L, the method for manufacturing a coil electronic component according to an exemplary embodiment may include an operation of applying insulating films on a support member on which a base conductor layer is disposed, and patterning the insulating films so that the base conductor layer is exposed, an operation of forming a single-layer coil part by performing plating, based on the base conductor layer between the patterned insulating films, an operation of laminating the insulating film on the coil part and machining a via, an operation of forming a metal layer by performing plating on the via and the insulating film and performing a patterning, and an operation of laminating the insulating film on the metal layer and machining a via to form the other single-layer coil part on the insulating film and the via.

Hereinafter, each of the operations will be described in detail.

1. Applying insulating films on a support member on which a base conductor layer is disposed and patterning the insulating films so that the base conductor layer is exposed.

Figure 4A:
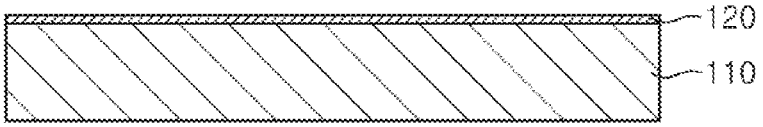
FIGS. 4A through 4L are views sequentially illustrating a method for manufacturing a coil electronic component according to an exemplary embodiment in the present disclosure.

Referring to FIG. 4A, a support member 110, on which a base conductor layer 120 is disposed, may be prepared. The support member 110 is not particularly limited, and any member may be used without being limited as long as it has sufficient rigidity to serve as a support.

The base conductor layer 120 disposed on the support member 110 is not particularly limited, and may be, for example, a copper foil.

Figure 4B:
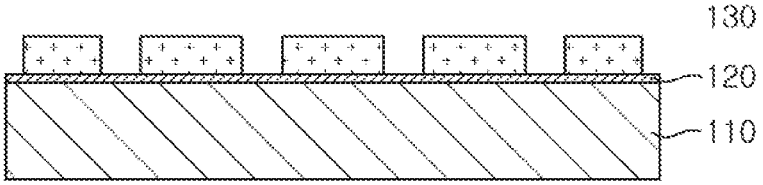

Referring to FIG. 4B, insulating films 130 may be applied onto the base conductor layer 120, and the insulating films 130 may be patterned so that portions of the base conductor layer 120 is exposed.

The insulating films 130, which are photosensitive insulating films, may be formed of, for example, an epoxy based material, but are not necessarily limited thereto.

In addition, the operation of patterning the insulating films 130 may be formed by an exposure and development operation of a photo resist (PR).

2. Forming a coil part by performing plating on the base conductor layer between the patterned insulating films.

Figure 4C:
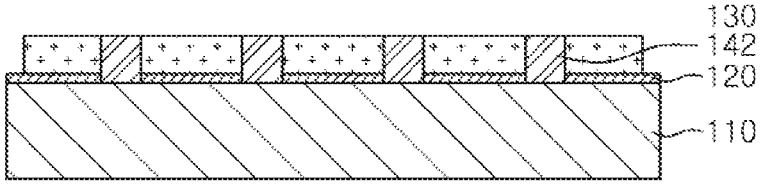

Referring to FIG. 4C, a first coil part 142 may be formed by plating, using the base conductor layer 120 as a seed layer.

The first coil part 142 may be formed of a copper (Cu) material by electroplating.

The first coil part 142 may correspond to the second coil part 42 disposed on a lower surface of the substrate, in the coil electronic component according to an exemplary embodiment.

3. Laminating the insulating film on the coil part and machining a first via.

Figure 4D:
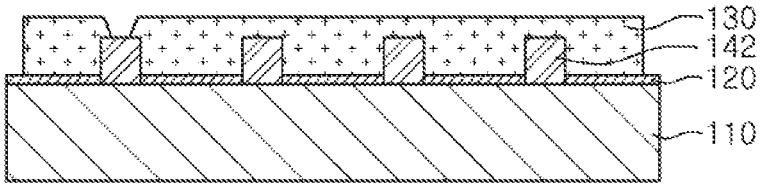

Referring to FIG. 4D, the insulating film may be laminated on the first coil part 142, and a first via may be machined by a patterning operation.

4. Forming a metal layer by performing plating on the first via and the insulating film and performing a patterning.

Figure 4E:
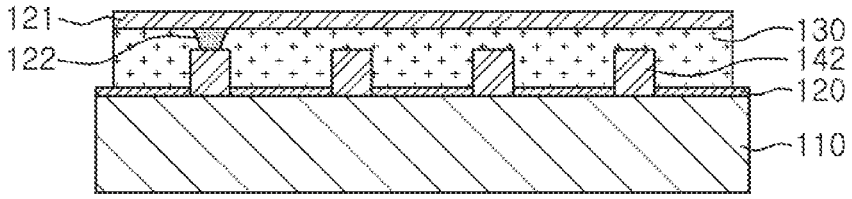

Referring to FIG. 4E, plating may be performed on the first via and the insulating film.

The first via 122 may be formed of a metal having excellent electrical conductivity, and may be formed of, for example, silver (Ag), palladium (Pd), aluminum (Al), nickel (Ni), titanium (Ti), gold (Au), copper (Cu), platinum (Pt), or an alloy thereof.

In addition, the first via 122 may be formed by filling a metal having excellent electrical conductivity by electroplating, and copper (Cu) may be used in an exemplary embodiment.

The operation of performing plating on the insulating film 130 may be performed by chemical plating, using copper (Cu) as a material.

Figure 4F:
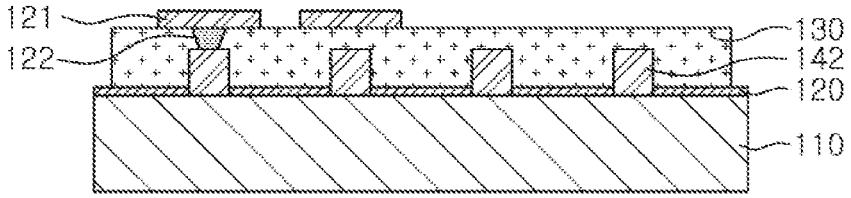

Referring to FIG. 4F, a metal layer 121 may be formed by patterning a plating layer formed on the insulating film 130.

The metal layer 121 may have a coil form.

Since the metal layer 121 having the coil form is connected to the coil part 142 through the via 122, an effect of increasing the number of windings may occur. As a result, inductance of the coil electronic component may be increased.

The metal layer 121 may have a shape in which a width is greater than a thickness, and may have an aspect ratio of less than 1.0, the aspect ratio being a ratio of a thickness to a width.

In contrast, the coil part 142 may be thicker than they are wide, and may have the aspect ratio of 1.0 or more, the aspect ratio being a ratio of a thickness to a width.

Due to the shape of the metal layer 121 described above, electrical loss of the DC resistance Rdc and capacity may be prevented.

5. Laminating the insulating film on the metal layer and machining a second via to form the second coil part on the insulating film and the second via.

Figure 4G:
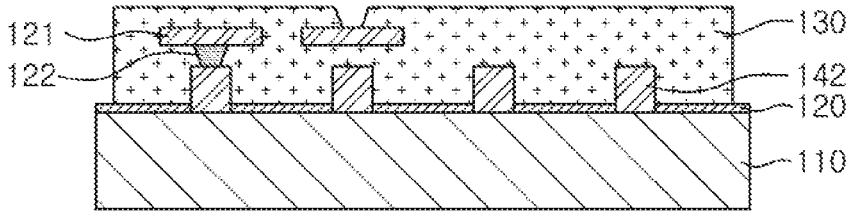

Referring to FIG. 4G, the insulating film 130 may be laminated on the metal layer 121, and may be patterned to machine a second via.

The above-mentioned operation is the same as the operation described in FIG. 4D.

Figure 4H:
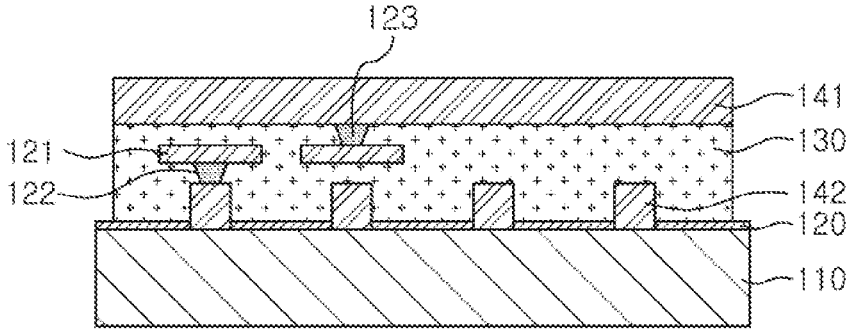

Referring to FIG. 4H, the second coil part 141 may be formed by performing plating on the second via 123 and the insulating film 130.

The second via 123 may be formed by filling a metal having excellent electrical conductivity by electroplating, and copper (Cu) may be used in an exemplary embodiment.

The operation of performing plating on the insulating film 130 may be performed by chemical plating using copper (Cu) as a material.

Figure 4I:
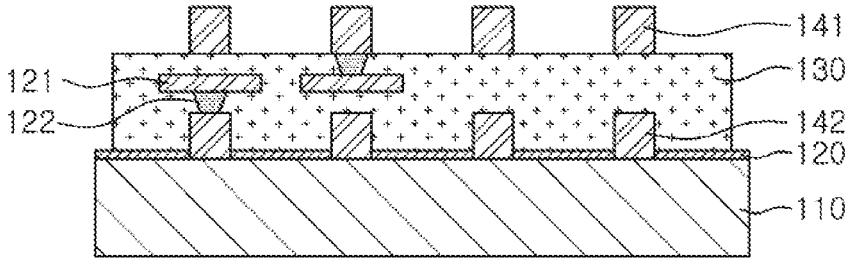

Referring to FIG. 4I, the second coil part 141 may be formed by patterning a plating layer formed on the insulating film 130.

The second coil part 141 may correspond to the first coil part 41 disposed on an upper surface of the substrate, in the coil electronic component according to an exemplary embodiment.

6. Forming a body by laminating the insulating film and removing the support member and the base conductor layer.

Figure 4J:
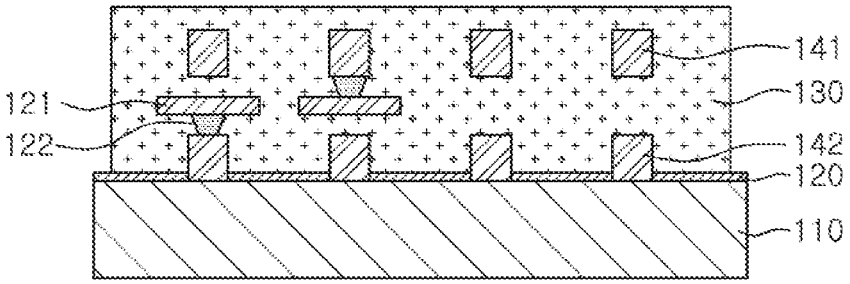

Referring to FIG. 4J, the insulating film 130 may be laminated on the other single-layer coil part 141.

Figure 4K:
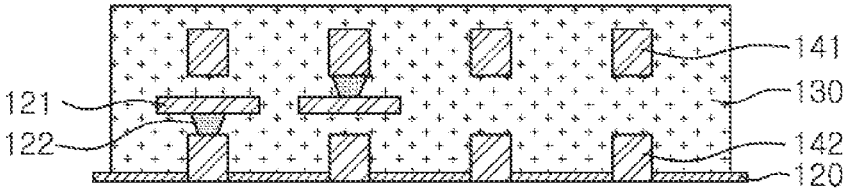
Figure 4L:
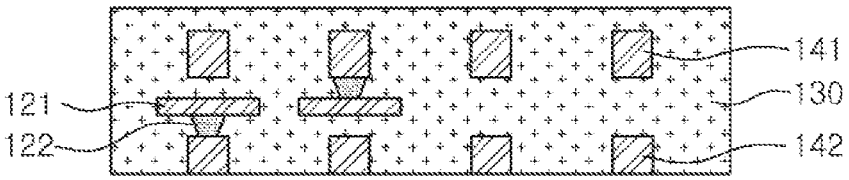

Referring to FIGS. 4K and 4L, as a subsequent operation, a body may be formed by removing the support member 110 and the base conductor layer 120.

Thereby, the coil electronic component according to an exemplary embodiment may have the body in which the metal layer 121 is disposed between the first and second coil parts 141 and 142.

Except for the above-mentioned description, a description of characteristics overlapping those of the coil electronic component according to an exemplary embodiment described above will be omitted.

As set forth above, according to the exemplary embodiments in the present disclosure, the inductance may be increased and rigidity of the substrate may be improved, based on the increase in the number of turns of the coil, by inserting the metal layer into the substrate.

Since the rigidity of the substrate may be improved, the thickness of the substrate may be formed to be thinner, whereby the fraction of volume occupied by the substrate within the component may be further decreased.

Thereby, even if the size of the coil electronic component is miniaturized, a problem of inductance degradation may be avoided.

According to an exemplary embodiment, since the metal layer inserted into the substrate is wider than it is thick, and is in the shape of the coil, it may prevent the loss of electrical characteristics.

While exemplary embodiments have been shown and described above, it will be apparent to those skilled in the art that modifications and variations could be made without departing from the scope of the present invention, as defined by the appended claims.

What is claimed is:

1. A coil electronic component comprising:

a body including an insulating substrate encapsulating a metal layer and coil parts disposed in first and second surfaces of the substrate; and external electrodes formed on outer surfaces of the body and connected to the coil parts, wherein the insulating substrate comprises a first insulating film and a second insulating film, a lower surface of one of the coil parts is exposed to a lower surface of the first insulating film and an upper surface of an other coil part is covered by the second insulating film.

2. The coil electronic component of claim 1, wherein the coil part and the metal layer are connected to each other through a via.

3. The coil electronic component of claim 1, wherein the coil part has a thickness greater than a width.

4. The coil electronic component of claim 1, wherein the metal layer has a width greater than a thickness.

5. The coil electronic component of claim 1, wherein the substrate has a thickness of 5 μm or more to 60 μm or less.

6. The coil electronic component of claim 1, wherein the metal layer has a coil form.

7. The coil electronic component of claim 1, wherein the metal layer has an aspect ratio of less than 1.0, the aspect ratio being a ratio of a thickness to a width.

8. A coil electronic component comprising:

a body including an upper coil part and a lower coil part;

external electrodes formed on outer surfaces of the body and connected to the upper and lower coil parts; and a metal layer disposed in an insulating substrate between the upper and lower coil parts, the insulating substrate comprising a first insulating film and a second insulating film, wherein the lower coil part is embedded in the first insulating film and a lower surface of the lower coil part is exposed to a lower surface of the first insulating film, and an upper surface of the upper coil part is covered by the second insulating film.

9. The coil electronic component of claim 8, wherein the metal layer has a coil form.

10. The coil electronic component of claim 8, wherein the metal layer is connected to the two coil parts through vias.

* * * * *